United States Patent [19]

Bauch et al.

[11] 4,155,512

[45] May 22, 1979

[54] BOBBIN HOLDER

[75] Inventors: Ernst Bauch, Bordesholm; Brüno Eigenwald; Kurt Eschke, both of Neümuenster, all of Fed. Rep. of Germany

[73] Assignee: Neumuenstersche Maschinen- und Apparatebau Gesellschaft mbH, Neumünster, Fed. Rep. of Germany

[21] Appl. No.: 922,741

[22] Filed: Jul. 7, 1978

[30] Foreign Application Priority Data

Jul. 22, 1977 [DE] Fed. Rep. of Germany ..... 2733120

[51] Int. Cl.[2] ..... B65H 54/02; B65H 54/20; B65H 75/32

[52] U.S. Cl. ..... 242/18 R; 242/18 A; 242/18 PW; 242/19; 242/35.5 R

[58] Field of Search ..... 242/18 R, 18 A, 18 PW, 242/18 DD, 19, 35.5 A, 41, 35.5 R, 125.1

[56] References Cited

U.S. PATENT DOCUMENTS

| | | | |
|---|---|---|---|
| 2,931,587 | 4/1960 | Pistor | 242/18 PW |
| 3,030,039 | 4/1962 | Roberts | 242/18 PW |
| 3,767,129 | 10/1973 | Sobel | 242/18 PW X |
| 4,014,476 | 3/1977 | Turk et al. | 242/19 |

*Primary Examiner*—Stanley N. Gilreath
*Attorney, Agent, or Firm*—Michael J. Striker

[57] ABSTRACT

A bobbin holder, particularly in thread winding machines, comprises an elongated support operative for replaceably receiving a set of separate bobbins. The bobbins are subject to axial withdrawal from the support upon winding onto the bobbins of a predetermined amount of thread. The holder is further provided with an element for cutting the thread when a bobbin is filled. This element is mounted on the support for movement relative to the latter between a rest position and a working position in which it is operable to cut the thread.

24 Claims, 6 Drawing Figures

BOBBIN HOLDER

BACKGROUND OF THE INVENTION

The present invention relates to a bobbin holder.

More particularly, this invention concerns bobbin holders in thread winding machines.

It is known in the art to provide an elongated support for a set of two or more bobbins and a number of cutting members equal to the number of bobbins. It is very essential that such cutting members do not interfere with either the withdrawal of the filled bobbins from the support or the installing of new empty bobbins on the support. This is especially important in applications where the process of winding the thread onto the bobbins must not be interrupted so that automatic thread transfer from a full bobbin to an empty one, and replacement of the full bobbin with another empty bobbin, must be employed.

An analogous arrangement, see for example German allowed application No. 24 55 116, includes a cutting member which is covered by a movable bobbin holder. To render such a construction possible it is necessary to provide the holder with a groove for receiving the cutting member and a spacer to prevent the cutting member from moving away from the holder. In order to cut the thread, the same has to be displaced inside the holder. Such a thread is subject to becoming slack when a drop of the speed of this thread takes place. Such slack disappears only when the thread tension subsequently increases again rapidly, so that the thread is pulled onto the cutters and tears off. As a result, one end of the thread, sometimes even a small loop, extends between the holder and the cutting element. During withdrawing of the bobbin from the holder this end of the thread can be caught and becomes untangled. Also, before installing a new empty bobbin torn-off thread pieces must be removed. Furthermore, in the prior art the thread is not cut but is torn off across the sharp edges of the cutting element.

SUMMARY OF THE INVENTION

It is a general object of the present invention to avoid the disadvantages of the prior art bobbin holders.

More particularly, it is an object of the present invention to provide a bobbin holder which has such a construction of the cutting element, that a thread to be cut slides along a sharp edge of the cutting element and is cut on the holder.

Another object of the present invention resides in providing such a cutting element on the bobbin holder as to insure that no end of thread can be caught between the holder.

In pursuance of these objects and others which will become apparent hereafter, one feature of the present invention resides in a provision of an elongated support and a set of at least two separable bobbins replaceably received on said support. The bobbins are subject to axial withdrawal from the support upon winding onto the bobbins of a predetermined amount of filamentary material (for example thread) to fill the bobbins.

The holder is further provided with means for cutting the filamentary material when a respective one of said bobbins has received said predetermined amount of filamentary material. These means are mounted on the support for movement relative to the latter between a rest position and a working position in which it is operable to cut said filamentary material.

The holder is provided with means for displacing the cutting means between said positions thereof in response to replacement of the filled bobbins with new empty bobbins.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
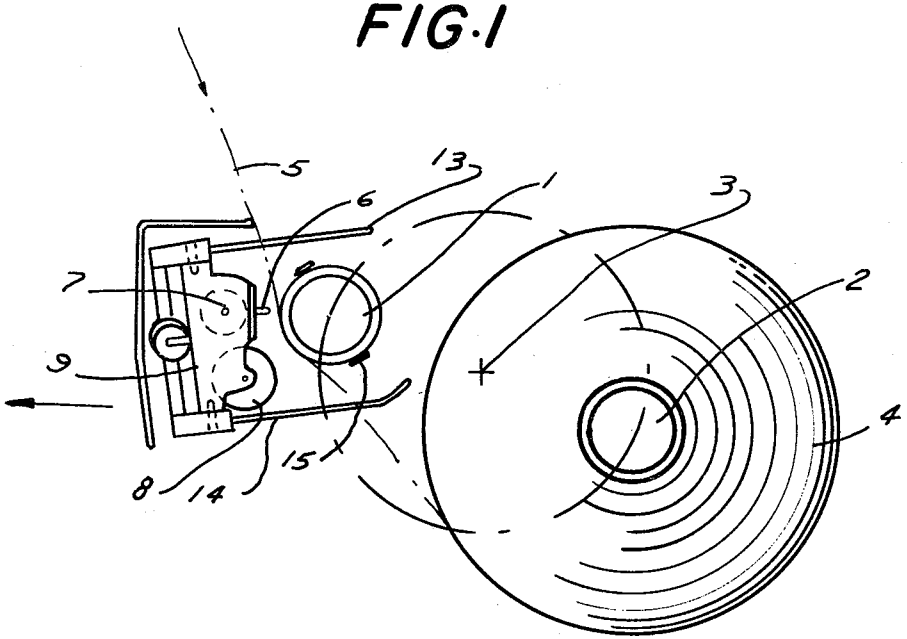
FIG. 1 is a schematic front view of a bobbin holder in accordance with the present invention.

Referring now to the drawings and first to FIG. 1 thereof, it may be seen that the reference numerals 1 and 2 designate two supports 1 and 2 of a bobbin holder which is rotatable about axis 3. The filled bobbin 4 of the support 2 is rotatable (as shown in FIG. 1) about the axis 3. Both supports 1 and 2 are driven separately. A thread 5 runs about an empty tube of the support 1 towards and onto the filled bobbin 4 of the support 2. In such a position the thread 5 will not be engaged by the thread layer 6 of a thread laying device 7 and a back-up roller 8 does not touch the tube of the support 1. As the diameter of the winding bobbin on the tube of the support increases, the complete thread laying arrangement 9 moves leftwardly as shown by the arrow.

Figure 2:
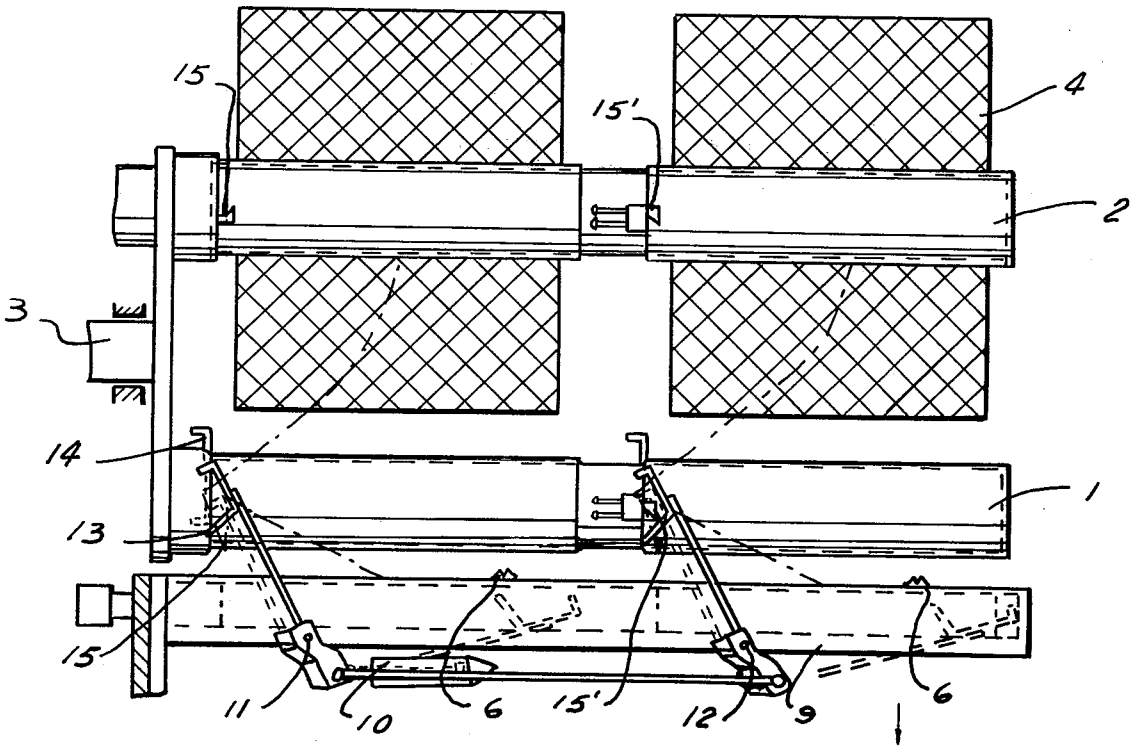
FIG. 2 is a plan view of the bobbin holder.
Figure 3:
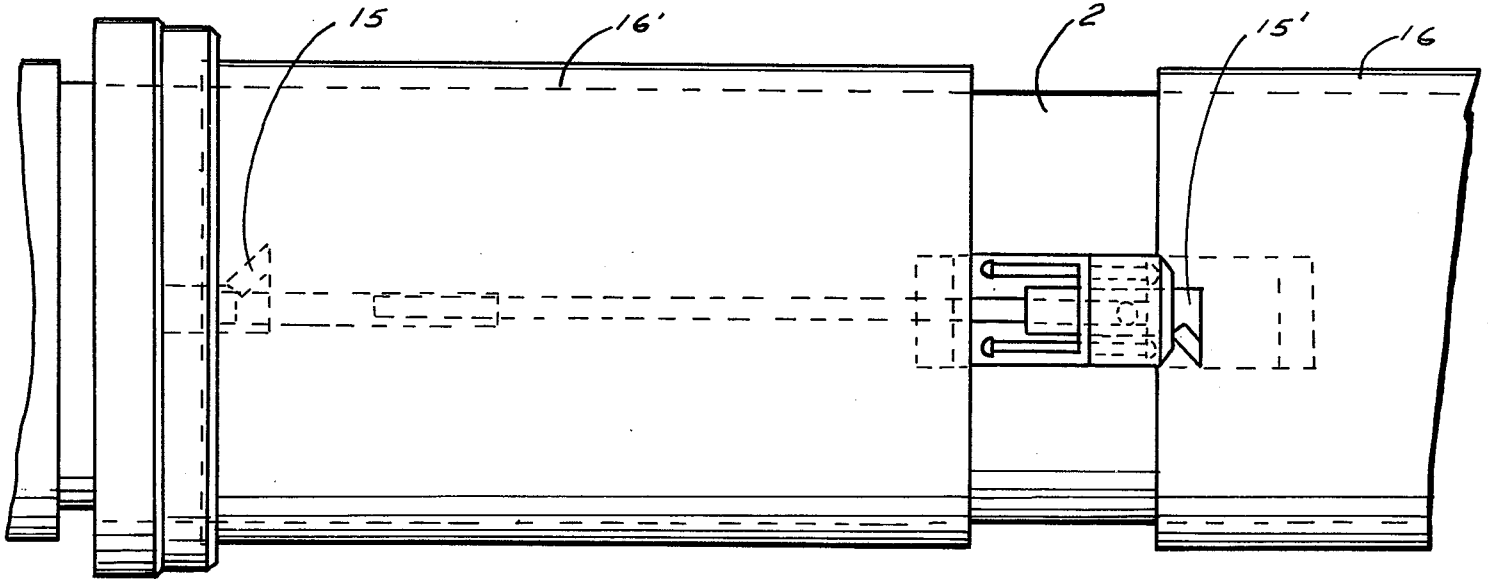
FIG. 3 is a view of two bobbins mounted on a support.

FIG. 2 shows the moment at which the thread is transferred from the filled bobbin on the support 2 to the new empty bobbins on the support 1. A pneumatic piston 10 pivots gripping hooks 13 and 14 about axes 11 and 12 which are respectively located at the upper and underside of the support. As a result, the threads 5 are displaced to a position where it can be engaged by catching and cutting blades 15 and 15', respectively. The blades 15 and 15' catch the threads 5 and sever them so that they can be wound onto the empty bobbin tubes. The gripping hooks 13 and 14 pivot back from the area of the bobbins and return to the position shown in FIG. 2 by dotted lines. Then the bobbin holder rotates counterclockwise until the tube of the support 1 abuts the back-up roller 8 (see FIG. 1). In this position the thread 5 will be taken over from the thread layer 6. The process of replacement of the filled bobbins with new empty bobbins is now over.

Two tubes 16 and 16' are installed on the support 2. The catching-and cutting-blade 15 is fixedly mounted on the support 2. The swingable catching-and cutting-blade 15' is located between previously installed tubes 16 and 16'.

Figure 4:
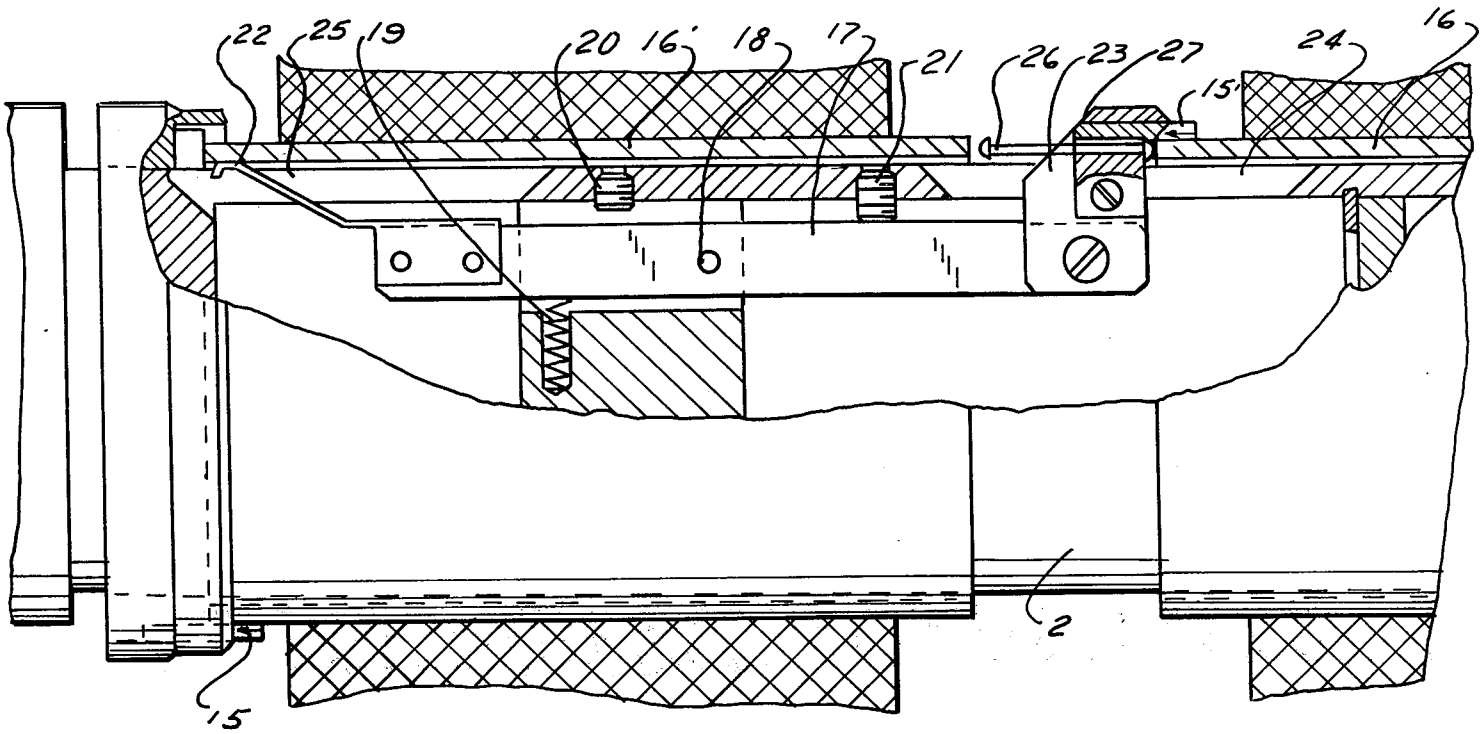
FIG. 4 through FIG. 6 are sectional views of two filled bobbins in different positions.
Figure 5:
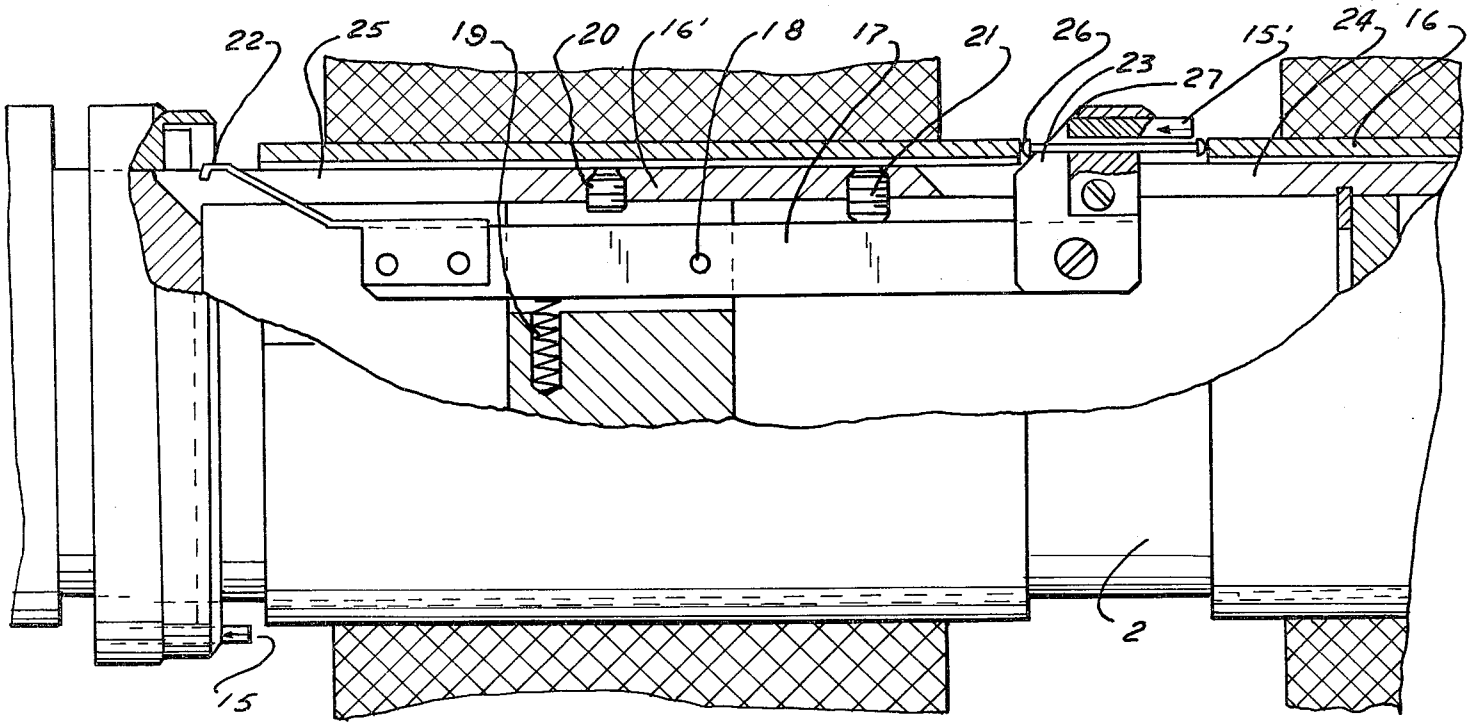
Figure 6:
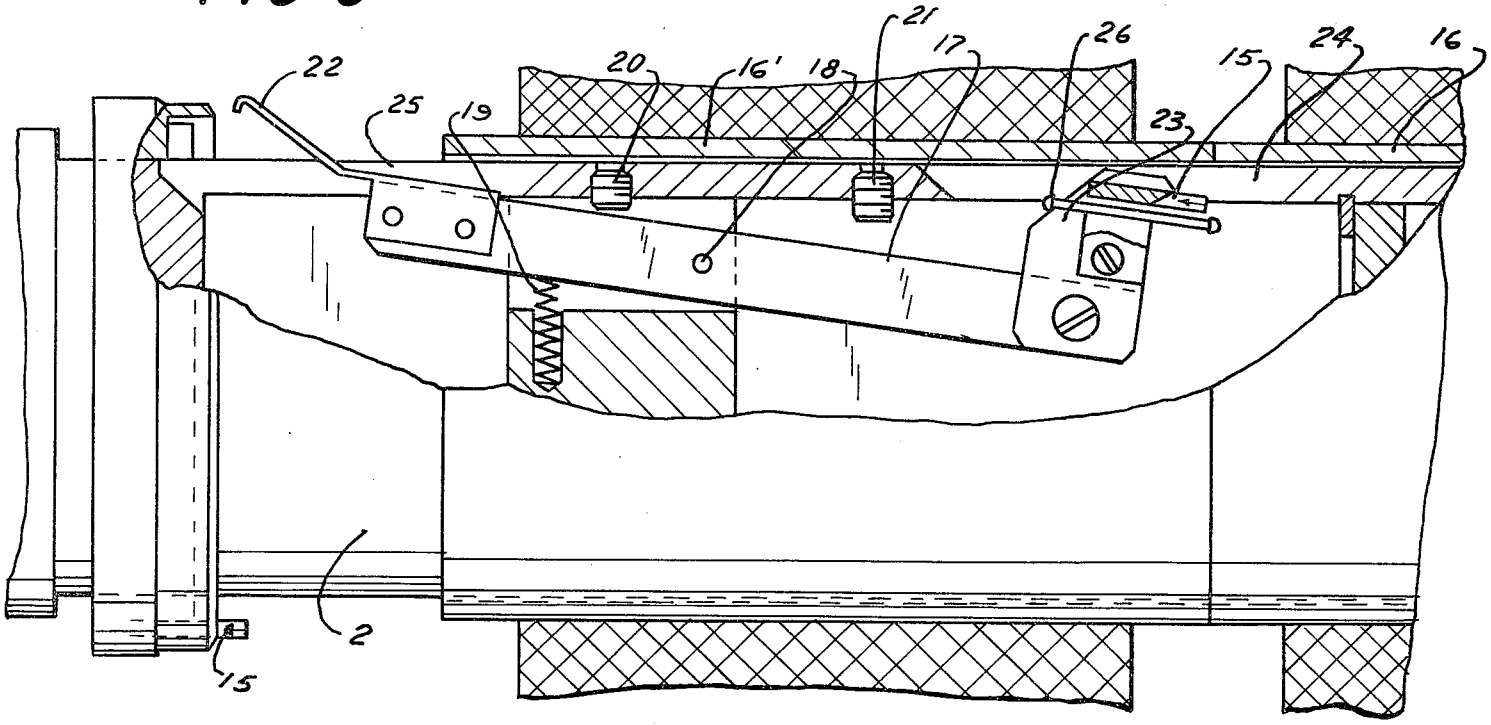

FIGS. 4 through 6 show the position and function of the swingable catching- and cutting-blade 15'. Inside the hollow support 2 there is provided a lever 17, which is pivotable about a pin 18. The lever has one end which is provided with a tool holder (i.e. adapter) 23 with the catching- and cutting-blade 15'. The other end of the lever 17 is provided with a flat spring 22. To pivot the lever 17 there is provided a compression spring 19. The spring 19 is so spaced from the pin 18 that when the tube 16' does not depress the end of the lever 17 then the other end of the lever 17 with the cutting blade 15' moves downwardly and the opposite end with the flat spring 22 moves upwardly. Throughgoing recesses 24 and 25 are provided in the wall of the support 2 for receiving the adapter 23 and the flat spring 22, respectively. In order to limit the displacement of the lever 17 there are provided end screws 20 and 21.

The adapter 23 is provided with a horizontal pushing pin 26, which during displacement of the tubes 16 and 16' from the support 2 pushes the tube 16 forward, so that the catching- and cutting-blade 15' will pivot downwardly. This is essential, in order to permit a releasing mechanism (not shown) to withdraw the filled bobbins 16 and 16' together from the support 2. The pin 26 is mounted on the adapter 23 below the cutting blade.

The pin 26 is a longitudinal body, which is provided with a leading end portion and a trailing end portion. The leading and trailing end portions have cross-sectional dimensions exceeding that of the body.

FIG. 5 shows the beginning of common withdrawal of the filled bobbins on the tubes 16 and 16'. Due to the displacement of the tube 16' the pushing pin 26 pushes the tube 16 so far rightwardly that the lever 17 with the adapter 23 pivots downwardly. In addition, the tube 16' presses against the tapered surface 27 of the adapter 23 and thus maintaining the downwardly pivoting of the adapter 23 with the cutting blade.

FIG. 6 shows a following step of the withdrawal. The lever 17 with the adapter 23 pivots so far downwardly that the bobbins can be withdrawn without any hindrance.

When new empty tubes are inserted into the support 2, they are moved until after the tube 16' abuts the end stop. The tube 16' presses the flat spring 22 downwardly and consequently the adapter 23 upwardly. Then, the tube 16 is installed on the support 2.

It will be understood that each of the elements described above, or two or more together, may also find a useful application in other types of a bobbin holder.

While the invention has been illustrated and described as embodied in a bobbin holder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed as new and desired to be protected by Letters Patent is set forth in the appended claims:

1. A bobbin holder, particularly in thread winding machines, comprising an elongated support; a set of at least two separate bobbins replaceably received on said support, said bobbins being subject to axial withdrawal from said support upon winding onto said bobbins of a predetermined amount of filamentary material to fill the bobbins; means for cutting the filamentary material when a respective one of said bobbins has received said predetermined amount of filamentary material, and including movable cutting means mounted on said support for movement relative to the latter between a rest position and a working position in which it is operable to cut said filamentary material; and means for displacing said movable cutting means between said portions thereof in response to replacement of the filled bobbins with new empty bobbins.

2. A holder as defined in claim 1, wherein said cutting means comprise at least two cutting members.

3. A holder as defined in claim 2, wherein the number of cutting members corresponds to the number of bobbins received on said support.

4. A holder as defined in claim 3, wherein said support is a hollow tube having an outer circumference operative for receiving thereon said bobbins.

5. A holder as defined in claim 4, wherein said outer circumference of said tube is provided with a first throughgoing recess and a second throughgoing recess longitudinally spaced from said first recess by a predetermined distance.

6. A holder as defined in claim 5, wherein said cutting means comprise a lever pivotably mounted inside said tube and having a first end portion adjacent to said first recess and a second end portion adjacent to said second recess.

7. A holder as defined in claim 6, wherein said second end portion of said lever is provided with an adapter operative for holding the cutting member and being arranged on said lever so as to extend through said second recess with said cutting member located above said outer circumference of said tube when said movable cutting means are in said working position.

8. A holder as defined in claim 7, wherein said first end portion of said lever is provided with first resilient means so arranged on said lever as to extend in said first recess when said cutting means are in said working position.

9. A holder as defined in claim 8, wherein said lever is pivotable about an axis, said displacing means comprise second resilient means urging said lever to pivot about said axis so as to move out from said first recess and said second end portion with said cutting member downwardly and inwardly into said second recess.

10. A holder as defined in claim 9, wherein said first resilient means constitute a flat spring.

11. A holder as defined in claim 10, wherein said second resilient means constitute a spring.

12. A holder as defined in claim 11, wherein said two bobbins are so received on said tube that a leading bobbin of said two bobbins overlaps said first recess to thereby prevent pivoting said lever thus keeping said lever in said working position, and a following bobbin being spaced from said first bobbin by a space sufficient to receive therethrough said adapter provided on the second end portion of said lever.

13. A holder as defined in claim 12, further comprising first means for limiting displacement of said movable cutting means from said rest position into said working position, resulting in cutting said filamentary material.

14. A holder as defined in claim 13, further comprising second means for limiting displacement of said movable cutting means from said working position into said rest position.

15. A holder as defined in claim 14, wherein said first limiting means comprise a first end element adjustably mounted on an inner circumference of said movable tube and extending inwardly from said inner circumference by a first predetermined distance, said first end element being adjacent to said second end portion of said lever so as to prevent undesirable excessive movement of said second end portion upwardly in response to displacement of said cutting means from said rest position into said working position.

16. A holder as defined in claim 15, wherein said first end element is a first stop screw.

17. A holder as defined in claim 16, wherein said second limiting means comprise a second end element adjustably mounted on an inner circumference of said tube and extending inwardly from said inner circumference by a second predetermined distance, said second end element being adjacent to said first end portion of said lever so as to prevent undesirable excessive movement of said first end portion upwardly in response to displacement of said movable cutting means from said working position into said rest position when replacing of the filled bobbins with new empty bobbins.

18. A holder as defined in claim 17, wherein said first end element is a second stop screw.

19. A holder as defined in claim 18, further comprising means for pushing said following bobbin of said two bobbins in response to withdrawing movement of said leading bobbin from said tube.

20. A holder as defined in claim 19, wherein said pushing means comprise a pin fixedly mounted in said adapter and having a longitudinally elongated body, a leading end portion directed towards a rear end face of the leading bobbin and a trailing end portion directed towards a front end face of said following bobbin to thereby transmit withdrawing force from the leading bobbin onto the following bobbin.

21. A holder as defined in claim 20, wherein said pin is mounted on said adapter below said cutting member.

22. A holder as defined in claim 21, wherein said leading end portion of said pin has a cross-sectional dimension exceeding that of the body of the pin.

23. A holder as defined in claim 22, wherein said trailing end portion of said pin has a cross-sectional dimension exceeding that of the body of the pin.

24. A holder as defined in claim 23, wherein said adapter has an upper surface portion tapered towards said leading bobbin.

* * * * *